United States Patent [19]

Tanaka

[11] 3,943,871

[45] Mar. 16, 1976

[54] SUBMERGING SYSTEM FOR MARINE STRUCTURE

[76] Inventor: Kazuhide Tanaka, No. 3743, Izumi-cho, Totsuka, Yokohama, Kanagawa, Japan

[22] Filed: Mar. 22, 1974

[21] Appl. No.: 453,581

[52] U.S. Cl. ..... 114/66; 9/8 R; 61/69 R; 114/16 R; 114/230

[51] Int. Cl.[2] ..... B63C 11/00

[58] Field of Search ..... 114/.5 R, 16 R, 230, 66; 9/8 R, 8 P, 9; 61/46.5, 69 R, 69 A

[56] References Cited

UNITED STATES PATENTS

| | | | |
|---|---|---|---|
| 3,351,965 | 11/1967 | Burkhardt | 9/8 R |
| 3,641,776 | 2/1972 | Diamond | 61/69 R |
| 3,722,223 | 3/1973 | Gratz | 9/8 P |
| 3,774,253 | 11/1973 | Lecomte | 114/230 |

*Primary Examiner*—Trygve M. Blix
*Assistant Examiner*—Charles E. Frankfort

[57] ABSTRACT

A submerging system for marine structure which comprises a floating capsule structure, sumbersibly anchored by a lever pivoted at one end to the bottom of the floating structure and at its opposite end to a mooring block fixed to the sea bottom, a land based winch being provided for submerging the structure and a cable is connected to the bottom of the capsule structure by way of a pulley supported from the sea bottom.

2 Claims, 1 Drawing Figure

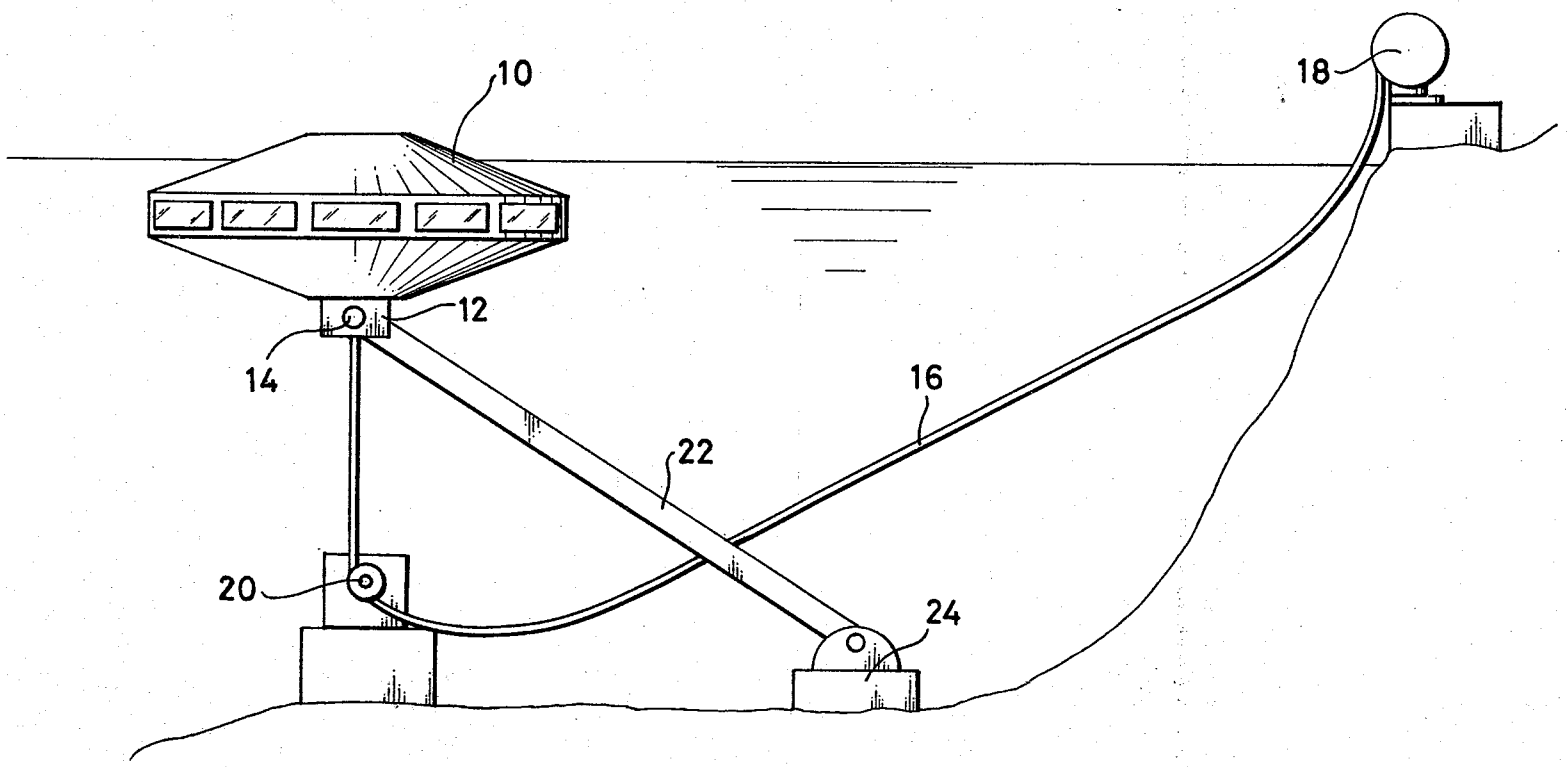
10
12
14
16
18
20
22
24

SUBMERGING SYSTEM FOR MARINE STRUCTURE

BACKGROUND OF THE INVENTION

This invention relates to a submerging system for marine structure.

Heretofore, the marine structure has been often suspended or submerged in the sea by a certain mechanical operation. However, any convenient way to move the marine structure upwardly and downwardly has not been developed and for this purpose an extremely complicate mechanical arrangement will be required.

SUMMARY OF THE INVENTION

It is therefore a general object of the invention to provide a novel submerging system for marine structure which is movable upwardly and downwardly in the sea by a simple operation.

More especially, there is provided in accordance with the invention, a submerging system for marine structure which comprises a floating structure, an anchoring means for submersibly anchoring the floating structure and a winch means for submerging the floating structure.

The floating structure is an air-tight capsule formed preferably in a symmetric trapezoidal shape to reduce the hydraulic pressure to be applied thereto. The anchoring means comprises a lever means pivoted at its one end to the bottom of the floating structure and at its opposite end to a mooring means fixed to the sea bottom. Further, the winch means includes a winch fixed on the land and a cable connected to the bottom of the floating structure through a pulley means fixed to the sea bottom.

BRIEF DESCRIPTION OF THE DRAWING

A more complete understanding of the invention may be gained from the following description and from the annexed drawing which illustrates a pictorial view of the arrangement embodying the invention.

DESCRIPTION OF THE PREFERRED EMBODIMENT

Referring to the drawing, the reference numeral 10 designates a capsule type restaurant structure which is prefabricated on the land and then placed on the sea. The structure 10 is provided with a bracket 12 at a middle bottom thereof. Over the bracket 12 is mounted a shaft 14 which holds one end of a cable 16 supplied and extended from a winch 18 fixed on the land, by way of a pulley 20 fixed to the sea bottom.

To the shaft 14 is also pivotably connected one end of a support lever 22 which is further pivoted at its opposite end to a mooring block 24 fixed to the sea bottom.

On submerging the structure, the winch is worked to draw the structure downwardly through the cable and the support lever inhibits any oscillation of the structure to ensure a stable submersion of the structure.

Since the air-tightened capsule structure operates as a float, the submerged structure may be moved upwardly by merely releasing the winch.

While a certain preferred embodiment of the invention has been illustrated by way of example in the drawing and particularly described, it will be understood that modification may be made in the constructions and that the invention is no way limited to the embodiment shown.

What I claim is:

1. Apparatus for maintaining a marine structure at a selected depth and in a substantially fixed position within a body of water and comprising a flotation, air tight, capsule, anchoring means comprising lever means pivoted non-rotatably at one end thereof to a bottom end portion of said capsule, a mooring block permanently fixed to the bed of said body of water and having the opposite end of said lever means connected thereto pivotally about a horizontal axis and nonrotatably, and a land based winch means for raising and lowering said marine structure within said body of water and, in cooperation with said lever means, for maintaining said marine structure at a selected depth and lateral distance from said mooring block in a substantially fixed vertical plane said winch means including a winch fixed to the land, a length of cable connected between the bottom end of the capsule and said winch, and pulley means permanently fixed to said water bed underlying the capsule, said cable extending substantially vertically downwardly from said capsule to be operatively connected about said pulley means and thence to said winch, whereby said winch may be operated to position said marine structure at the desired depth and said lever means and cable cooperate to maintain said structure at the selected depth and lateral distance from said mooring block.

2. Apparatus according to claim 1, wherein a bracket is provided on the capsule at the middle of the bottom thereof and a shaft is mounted on the bracket, said shafting holding one end of the cable and pivotably mounting said one end of said lever.

* * * * *